United States Patent [19]

Mseitif

[11] Patent Number: 4,738,756

[45] Date of Patent: Apr. 19, 1988

[54] METHOD OF BRUSH CHROME PLATING USING TANK CHROME PLATING SOLUTIONS

[75] Inventor: Walid M. Mseitif, Seattle, Wash.

[73] Assignee: The Boeing Company, Seattle, Wash.

[21] Appl. No.: 78,349

[22] Filed: Jul. 28, 1987

[51] Int. Cl.[4] ..... C25D 5/06

[52] U.S. Cl. ..... 204/15

[58] Field of Search ..... 204/15, 16, 32.1

[56] References Cited

U.S. PATENT DOCUMENTS

| | | | |
|---|---|---|---|
| 2,693,444 | 11/1954 | Suavely et al. | 204/43 |
| 2,794,303 | 6/1957 | Wickes | 51/170 |
| 3,183,176 | 5/1965 | Schwartz | 204/212 |
| 3,313,715 | 4/1967 | Schwartz | 204/36 |
| 3,393,134 | 7/1968 | Schwartz | 204/16 |
| 3,751,343 | 8/1973 | Macula | 204/15 |

*Primary Examiner*—T. M. Tufariello

*Attorney, Agent, or Firm*—Schwartz, Jeffery, Schwaab, Mack, Blumenthal & Evans

[57] ABSTRACT

A method of brush chrome plating a substrate is disclosed that utilizes a standard tank chrome plating solution instead of a specialized brush chrome plating solution. The use of a tank chrome plating solution reduces the expense of the brush chrome plating process while providing excellent plating characteristics. The disclosed method is particularly useful in repairing previously plated substrates without requiring the substrate to be completely stripped and replated.

9 Claims, 1 Drawing Sheet

METHOD OF BRUSH CHROME PLATING USING TANK CHROME PLATING SOLUTIONS

BACKGROUND OF THE INVENTION

The invention relates to a method of brush plating chrome on a substrate. In particular, the invention relates to a method of brush plating chrome that employs a tank chrome solution in the plating process.

Tank plating and brush plating are two well known techniques for plating the surface of a substrate with a plating material. In tank plating, the substrate to be plated is entirely emersed in a tank of plating solution and a plating current is passed through the substrate and the tank plating solution in order to electroplate a plating material, for example chrome, on the surface of the substrate. The entire exposed surface of the substrate is plated to a uniform thickness during the tank plating process. In contrast, brush plating is commonly employed to plate specific surface areas of the substrate. For example, brush plating has been employed to repair scratched or damaged areas of a previously plated surface. In brush plating, a plating solution is supplied to a hand-held anode that is passed over the surface of the area to be plated. As the anode is passed over the surface of the substrate, the plating solution is dispensed and a plating current is passed through the anode to the grounded substrate.

However, the use of brush plating to repair damaged chrome surfaces has not met with satisfactory results. Typically, the repaired area did not blend well with the unrepaired surface producing a visibly undesirable result. Problems with adhesion to the substrate were also experienced. Methods have been developed to address some of the aforementioned problems (See, for example, U.S. Pat. Nos. 3,751,343, 3,393,134, 3,313,715), however, these methods require the use of specialized brush plating solutions rather than the standard solutions used in tank plating methods.

In the area of chrome plating specifically, the specialized brush plating solutions require the use of sodium hydroxide and trivalent chromium in order to achieve adequate results. Another typical characteristic of specialized brush plating solutions is the use of a higher metal ion concentration than that employed in tank solution. As a result, the specialized brush plating solutions are typically more expensive than tank plating solutions. In addition, the aforementioned methods required that the area to be plated to be activated with a thin deposit of nickel. The requirement for a separate special brush plating solution to repair parts also results in additional expenses being required for double stocking two solutions.

SUMMARY OF THE INVENTION

An object of the present invention is to provide an inexpensive method of brush plating chrome on the surface of a substrate.

Another object of the invention is to provide a method of brush plating chrome on the surface of a substrate that does not require the deposition of a nickel layer to activate the surface to be plated.

A further object of the invention is to provide a method of brush plating chrome of the surface of a substrate that does not require the use of a specialized brush plating solution.

These and other objects are achieved in the present invention by providing a method of brush chrome plating that utilizes a typical tank plating solution in the brush plating process. In a preferred embodiment of the invention, a method of brush chrome plating is providing comprising the steps of:

a. connecting the surface of the substrate to be coated to a first electrode in an electrical circuit;
b. passing a second electrode connected in said electric circuit over said surface, said second electrode being spaced from said surface by a porous dielectric material, and concurrently with step b performing the steps of:
c. providing a plating solution to said porous material, said plating solution being a tank plating solution and comprising a solution of chromic acid and water;
d. applying a voltage across said first and second electrodes in a step-like manner until a current density of between about 5–8 amps/in$^2$ is obtained; and
e. maintaining said current density until a desired plating thickness is obtained.

The use of a tank plating solution significantly reduces the expense of the brush chrome plating process while at the same time providing a plating that has excellent visual qualities and adhesion characteristics.

DESCRIPTION OF THE DRAWING

With the above as background, reference should now be made to the following figures for a detailed description of the preferred embodiments.

DETAILED DESCRIPTION OF THE PREFERRED EMBODIMENTS

Figure 1:
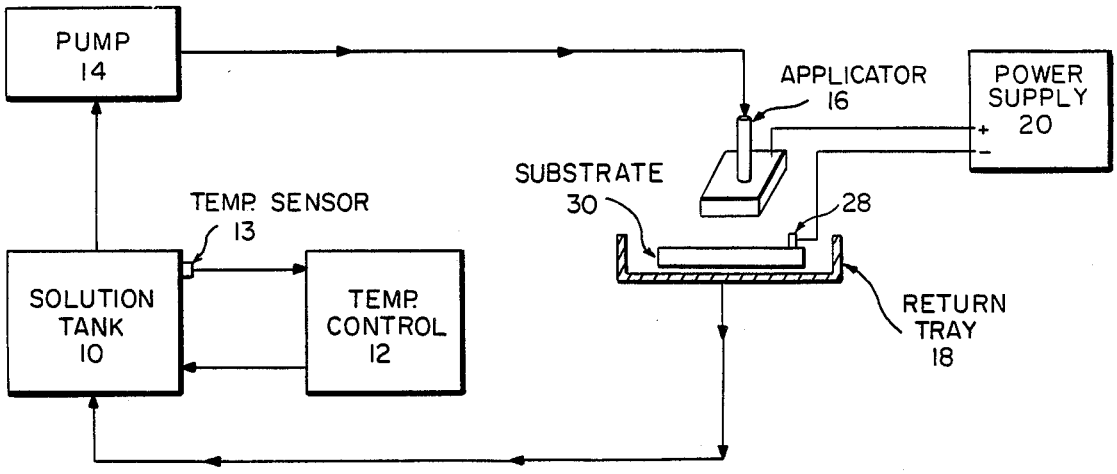
FIG. 1 is a block diagram of a brush plating apparatus employed to implement the present invention.
Figure 2:
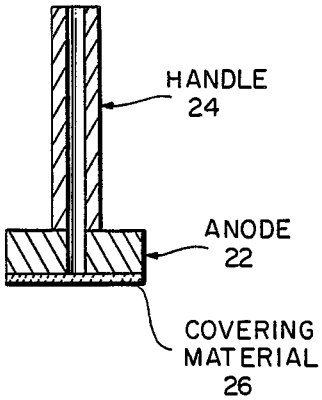
FIG. 2 is a cross-section of a hand-held applicator employed in the apparatus shown in FIG. 1.

Referring now to FIGS. 1 and 2, a brush plating apparatus used for implementing the present invention is shown having a solution tank 10, a temperature control mechanism 12, a pump 14, a hand-held applicator 16, a return tray 18, and a power supply 20. The applicator 16 consists of a graphite anode 22 and a hollow handle 24 as shown in FIG. 2. A porous anode covering (dielectric) material 26, such as Scotchbrite, covers the face of the anode 22.

In operation, the plating solution is placed in plating tank 10 and maintained at a desired temperature by the temperature control mechanism 12 in response to a signal received from the temperature sensor 13. The pump 14 pumps the plating solution to the applicator 16, where the solution enters the hollow handle 24, passes through an opening in the graphite anode 22, and saturates the anode covering material 26. An electrode 28 from the power supply 20 is attached to a substrate 30 which is to be plated. The substrate 30 is placed in the return tray 18. The applicator 16 is passed over the surface of the part 30 that is to be plated, as the power supply 20 maintains the desired voltage and current to generate the proper current density for a sufficient length of time to obtain the desired plating thickness. Excess solution is recycled from the return tray 18 to the solution tank 10.

Depending on the metal substrate and its condition, the plating surface must be properly prepared. As an example, in the case of a mild steel substrate with a relatively clean surface free of oil and scale, the following techniques may be employed: electroclean the surface using an alkaline solution (such as Dalic 1010 or Selectron 4100) at 8–15 volts forward current to provide a water break-free surface after rinsing; rinse thoroughly with water; etch using an acid solution (such as Dalic 1022 or Selectron 4300) at 6–15 volts reverse current until a uniformly etched surface has been obtained; rinse thoroughly with water; prepare the surface using an acid solution (such as Dalic 1023 or Selectron 4350) at 10–25 volts reverse current until the surface will not become lighter in color; and rinse thoroughly with water. At this stage the surface is ready to be brush chrome plated by the method of the instant invention.

As previously stated, the invention utilizes a typical tank plating solution in the brush plating process. The tank solution utilized is composed of distilled water and 2 lbs. of chromic acid ($CrO_3$) per gallon of solution. Typically, as a result of the plating process, certain impurities will develop as the plating solution is recycled. Therefore, the solution control levels shown in Table I should be maintained throughout the plating process by replenishing the recycled solution with fresh solution.

TABLE I

| MATERIAL | CONTROL |
|---|---|
| Chromic acid, $CrO_3$ | 30–33 oz/gal |
| $CrO_3/SO_4$ ratio | 100 ± 15 |
| Trivalent chromium | 0.53 oz/gal |
| Iron | 1.0 oz/gal |

The following examples illustrate the invention and should not be construed to limit the scope of the invention.

EXAMPLE 1

Two specimen blanks consisting of 1020 steel were brush chrome plated in accordance with the present invention by first preparing the surface of the specimen blanks as previously discussed. The specimen blanks were then plated using the tank plating solution previously specified in the plating apparatus shown in FIG. 1. The power supply voltage was initially set at zero volts and was increased in one volt increments every 15–30 seconds until the desired current density was achieved. Table II shows the operating parameters that were maintained during the plating process.

TABLE II

| Solution Temperature ≈°F. | Operating Current Density ≈Amps/in$^2$ | Operating Voltage ≈Volts | Starting Voltage ≈Volts | Anode to Cathode Speed ≈ft/min |
|---|---|---|---|---|
| 110–120 | 5–7 | 5–8 | 0 | 30–40 |

The parameters were previously established by plating additional specimens. Current densities less than 5 amps/in$^2$ failed to produce any significant plating, while current densities above 8 amps/in$^2$ burned the plating surface. The two specimen blanks were plated to a thickness of 0.00075" and 0.00078". Based on the results of the two specimens, it was determined that by plating at 6–7 volts and 5–6.5 amps/in$^2$, an average of 0.30 ampere hours are required to deposit 0.0001" of plating on a one square inch area. The time required for this deposition with 100% anode contact area was calculated to be between 2.8–3.6 minutes. The adhesion of the chrome plating to the specimen blanks was tested by both bending and chisel techniques and found to be excellent.

EXAMPLE 2

Three blank specimens composed of 4130 steel were prepared and plated in a manner similar to that of example one. During the plating process the operating parameters specified in Table II were maintained and the voltage was increased in a step-like manner as previously described. Two of the specimens were preplated with nickel in accordance with prior art practices. The two specimens were plated to a thickness of 0.001" and 0.0021". Both specimens experienced blistering and adhesion failure of the chrome plating. The third specimen was prepared without the nickel preplate, and was plated with chrome to a thickness of 0.00368" using the aforementioned process. The third specimen exhibited excellent adhesion characteristics.

A microhardness study was conducted on the 1020 and 4130 steel specimens with a tank chrome plated specimen measured for reference. The chrome plating on the sample specimens ranged from 0.0007" to 0.0037" and the hardness test was performed by using the Tukon tester and 250 gm load to measure Knoop hardness on the cross-section of the plating deposits. These hardness values were then converted to Rockwell hardness figures. The test point locations were at 25%, 50%, and 75% from the substrate. The test results showed that the plating hardness was consistent along the thickness of plating. Also, the average hardness value ($69R_c$) did not vary significantly between the thin coatings and thicker coatings. The hardness values obtained for the brush chrome plated sample specimens was very comparable to the hardness value obtained for the tank chrome plated reference.

The grain structure of the brush chrome plated sample specimens was also compared to the that of the tank chrome plated reference. The brush chrome plated specimens appeared to be slightly more porous than the tank chrome plated reference. However, high porosity in chrome is known to improve lubricity and is considered advantageous in wear applications in which lubrications is required, as the porosity promotes wetting action and provides oil retention after initial lubrication.

The disclosed method of brush chrome plating was also tested on tank chrome plated specimens to simulate plating repair. The brush chrome plated areas could be easily buffed to a satin finish, and visually conformed with the surrounding tank chrome plated areas. Tests were also conducted on curved surfaces to simulate build-up repair by first brush copper plating a 2.25" inside diameter surface followed by hard capping with brush chrome. The specimen showed good adhesion and the platings were defect free.

The invention has been described in detail with particular reference to certain preferred embodiments, but it will be understood that modifications and variations can be effected within the spirit and scope of the invention.

What is claimed is:

1. A method of brush electroplating chrome on the surface of a substrate, said method comprising the steps of:

a. connecting the surface of said substrate to a first electrode of an electrical circuit;

b. passing a second electrode connected to said electric circuit over said surface, said second electrode being spaced from said surface by a porous material;

c. providing a plating solution to said porous material, said plating solution being a tank plating solution and comprising a solution of chromic acid and water;

d. applying a voltage across said first and second electrodes in a step-like manner until a current density of between about 5–8 amps/in$^2$ is obtained; and e. maintaining said current density until a desired plating thickness is obtained.

2. A method as claimed in claim 1 wherein said plating solution is maintained at a temperature of between about 110–120 degrees Fahrenheit.

3. A method as claimed in claim 1 wherein said anode is passed over said surface at a rate of 30–40 feet per minute.

4. A method as claimed in claim 1, wherein said voltage is maintained between about 5–8 volts when said current density is obtained.

5. A method of brush electroplating chrome on the surface of a substrate as claimed in claim 1, wherein said tank plating solution consists essentially of a solution of chromic acid and water.

6. A method of brush electroplating chrome on the surface of a substrate as claimed in claim 1, wherein said voltage is maintained at between 6–7 volts and a current density is obtained of between 5–6.5 amps/in$^2$.

7. A method of brush electroplating chrome on the surface of a substrate as claimed in claim 1, wherein said first electrode is a cathode and said second electrode is an anode.

8. A method of brush electroplating chrome on the surface of a substrate as claimed in claim 1, wherein the following cleaning steps are performed prior to steps a–e:

(1) electrocleaning said surface using an alkaline solution at about 8–15 volts forward current;

(2) etching said surface using an acid solution;

(3) rinsing the surface with water; and (4) preparing said surface using an acid solution at about 10–25 volts reverse current.

9. An article of manufacture prepared by a brush chrome electroplating method comprising the steps of:

a. connecting the surface of said article to a first electrode of an electrical circuit;

b. passing a second electrode connected to said electric circuit over said surface, said second electrode being spaced from said surface by a porous material;

c. providing a plating solution to said porous material, said plating solution being a tank plating solution and comprising a solution of chromic acid and water;

d. applying a voltage across said first and second electrodes in a step-like manner until a current density of between about 5–8 amps/in$^2$ is obtained; and e. maintaining said current density until a desired plating thickness is obtained.

* * * * *